US007467880B2

(12) United States Patent
Gordin et al.

(10) Patent No.: US 7,467,880 B2
(45) Date of Patent: Dec. 23, 2008

(54) VISOR WITH TRANSLUCENT OR TRANSPARENT OPENING TO PROVIDE LIGHT ABOVE THE FIELD

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 108 days.

(21) Appl. No.: 11/333,995

(22) Filed: Jan. 18, 2006

(65) Prior Publication Data

US 2006/0176704 A1 Aug. 10, 2006

Related U.S. Application Data

(60) Provisional application No. 60/644,516, filed on Jan. 18, 2005, provisional application No. 60/644,517, filed on Jan. 18, 2005, provisional application No. 60/644,534, filed on Jan. 18, 2005, provisional application No. 60/644,536, filed on Jan. 18, 2005, provisional application No. 60/644,537, filed on Jan. 18, 2005, provisional application No. 60/644,546, filed on Jan. 18, 2005, provisional application No. 60/644,547, filed on Jan. 18, 2005, provisional application No. 60/644,609, filed on Jan. 18, 2005, provisional application No. 60/644,636, filed on Jan. 18, 2005, provisional application No. 60/644,637, filed on Jan. 18, 2005, provisional application No. 60/644,638, filed on Jan. 18, 2005, provisional application No. 60/644,639, filed on Jan. 18, 2005, provisional application No. 60/644,687, filed on Jan. 18, 2005, provisional application No. 60/644,688, filed on Jan. 18, 2005, provisional application No. 60/644,719, filed on Jan. 18, 2005, provisional application No. 60/644,720, filed on Jan. 18, 2005, provisional application No. 60/644,747, filed on Jan. 18, 2005, provisional application No. 60/644,784, filed on Jan. 18, 2005.

(51) Int. Cl.
*F21V 11/00* (2006.01)

(52) U.S. Cl. ..... 362/359; 362/307; 362/351

(58) Field of Classification Search ..... 362/297, 362/307, 344, 346, 348, 351, 359, 539, 269, 362/275, 354, 361

See application file for complete search history.

(56) References Cited

U.S. PATENT DOCUMENTS

| | | | | | |
|---|---|---|---|---|---|
| 1,148,650 | A | * | 8/1915 | Beauchamp | 362/359 |
| 1,412,411 | A | * | 4/1922 | McInroy | 362/341 |
| 1,508,791 | A | * | 9/1924 | Hoffman et al. | 362/359 |
| 1,708,561 | A | * | 4/1929 | Aud | 362/359 |
| 1,852,278 | A | * | 4/1932 | Anderson | 362/359 |

(Continued)

FOREIGN PATENT DOCUMENTS

EP 1 172 839 A2 1/2002

*Primary Examiner*—Y My Quach Lee
(74) *Attorney, Agent, or Firm*—McKees, Voorhees & Sease, P.L.C.

(57) ABSTRACT

An apparatus, method, and system for increasing usable light to a target area. One aspect of the invention includes a lighting fixture with a visor. The visor includes an opening through which a controlled amount of light is allowed generally upwardly. A controlled amount of light within provides some uplighting above the target area or above the fixtures. In another aspect of the invention, a lighting system with a plurality of lighting fixtures would have at least some of the fixtures fitted with the visors with the openings to create a cumulative uplighting effect.

10 Claims, 8 Drawing Sheets

U.S. PATENT DOCUMENTS

Figure 1:
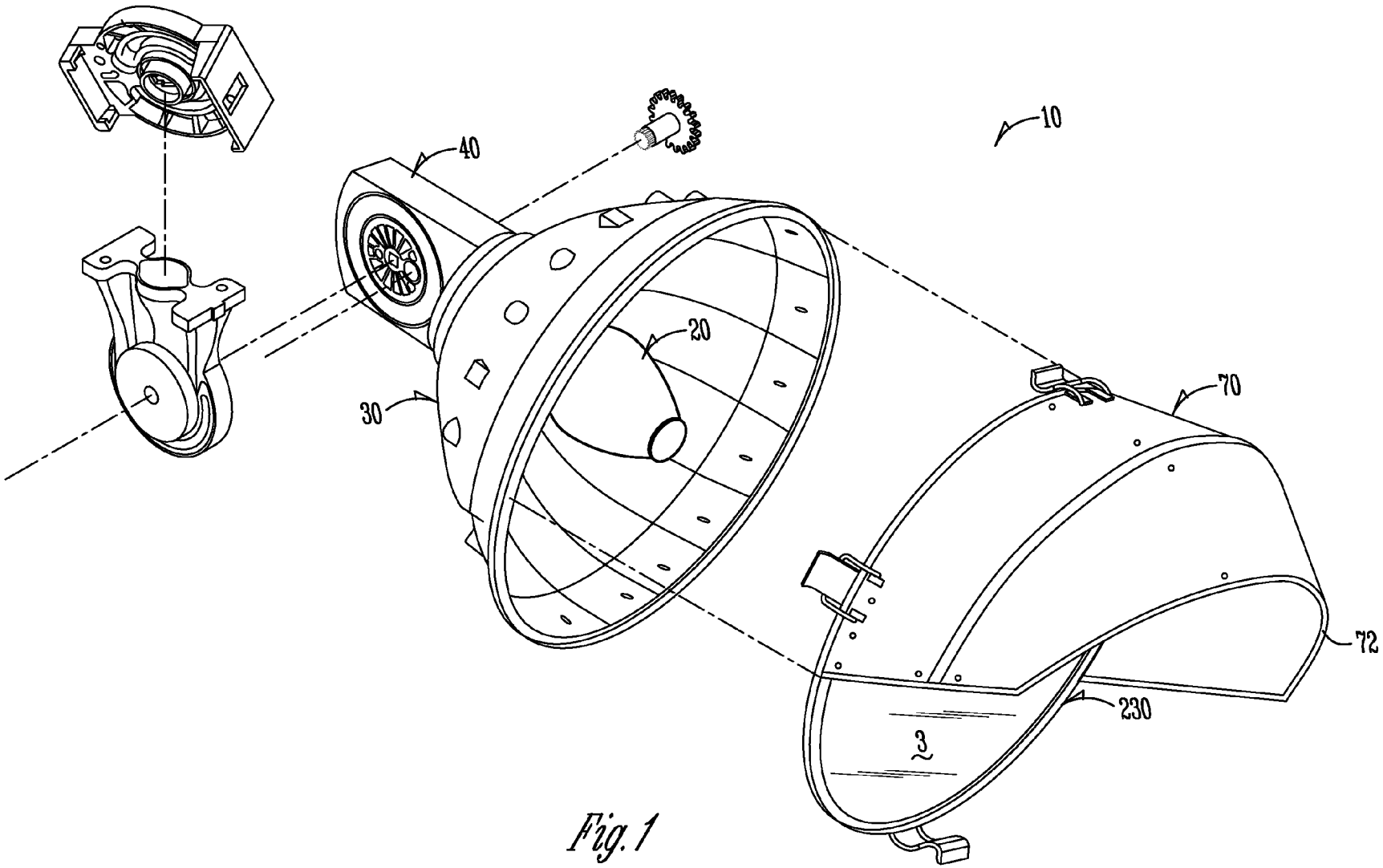

| | | | | | |
|---|---|---|---|---|---|
| 1,997,026 | A | * | 4/1935 | Weddel | 362/539 |
| 2,447,923 | A | | 8/1948 | Tuck | |
| 3,377,473 | A | * | 4/1968 | Breeding et al. | 362/294 |
| 4,816,974 | A | | 3/1989 | Gordin | |
| 4,947,303 | A | | 8/1990 | Gordin et al. | |
| 5,161,883 | A | | 11/1992 | Gordin et al. | |
| 5,600,537 | A | | 2/1997 | Gordin et al. | |
| 5,816,691 | A | | 10/1998 | Gordin et al. | |
| 5,856,721 | A | | 1/1999 | Gordin et al. | |
| 6,036,338 | A | | 3/2000 | Gordin | |
| 6,203,176 | B1 | | 3/2001 | Gordin | |
| 6,883,941 | B2 | * | 4/2005 | Cutting | 362/352 |

* cited by examiner

VISOR WITH TRANSLUCENT OR TRANSPARENT OPENING TO PROVIDE LIGHT ABOVE THE FIELD

CROSS REFERENCE TO RELATED APPLICATIONS

This application claims priority under 35 U.S.C. § 119 of a provisional application U.S. Ser. No. 60/644,609 filed Jan. 18, 2005, herein incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light. One primary example is illumination of a sports field. Furthermore, the present invention relates to lighting fixtures with visors that include an uplighting feature.

B. Problems in the Art

In recent times, sports lighting has also had to deal with the issue of glare and spill light. For example, if light travels outside the area of the sports field, it can spill onto residential houses near the sports field. Also, the high intensity of the lamps can cause glare to such homeowner or create safety issues for drivers on nearby roads. Some communities have enacted laws regulating how much glare or spill light can be caused by sports lighting or other wide-area outdoors lighting. While a number of attempted remedies exist, many result in blocking, absorbing, or otherwise reducing the amount of light going to the field. This can not only increase cost of the lighting system because of the glare or spill control measures, but in some cases requires additional fixtures to meet minimum light quantity and uniformity specifications. More cost might therefore be incurred, to make up for the light lost in glare and spill control measures. In some cases, it can even require more costly and/or additional poles to support the additional fixtures.

Therefore, competing interests and issues provide challenges to sports lighting designers. Some of the interests and issues can be at odds with one another. For example, the need always remains for more economical sports lighting. On the other hand, glare and spill control can actually add cost and/or reduce the amount of light available to light the field. One approach is to use a visor extending from the top side of the fixture to block light from traveling outside the target space. Designers have to balance a number of factors, for example, cost, durability, size, weight, wind load, longevity, and maintenance issues, to name a few. Attempts to advance the art have mainly focused on discrete aspects of sports lighting. For example, computerized design of lighting systems tends to minimize hardware costs and system installation costs but uses conventional lamp and fixture technology, with their weaknesses. Also, larger lumen output lamps produce more light, but are used with conventional fixture technology. A need, therefore, still exists for advancement in the art of sports lighting.

However, playability is also important. There must be sufficient light in the volume of space above the sports field so that players can see balls that travel into the air. For example, footballs, softballs, baseballs, soccer balls all can be kicked, thrown or hit quite high off the ground. Attempts to greatly curtail spill and glare light can be inconsistent with sufficient light above the field. There is a need in the art for an improvement in this area.

II. SUMMARY OF THE INVENTION

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) can provide a controlled amount of upright above the target space;

b) is robust and durable for most sports lighting or other typical applications for high intensity light fixtures of this type, whether outside or indoors;

c) can reduce glare and spill light relative a target space or area;

d) can reduce wind drag or effective projected area (EPA) of individual fixtures or sets of fixtures, which can allow smaller and/or less expensive elevating structures (e.g. poles), which in turn can materially decrease the capital cost of a lighting system.

In another aspect of the invention, an additional reflecting surface extends forwardly from the general surface of revolution of the main reflecting surface. The framework supporting the additional reflecting surface can be connected to the framework for the main reflecting surface in an integrated manner that also minimizes wind drag for the entire fixture. It also includes an opening to pass a controlled amount of light through the extended portion of the fixture for uplighting.

These and other objects, features, advantages and aspects of the present invention will become more apparent with reference to the accompanying specification and claims.

III. BRIEF DESCRIPTION OF THE DRAWINGS

FIG. 1 is a diagrammatic, partial exploded view of a light fixture 10 according to an exemplary embodiment of the present invention.

Figure 2A:
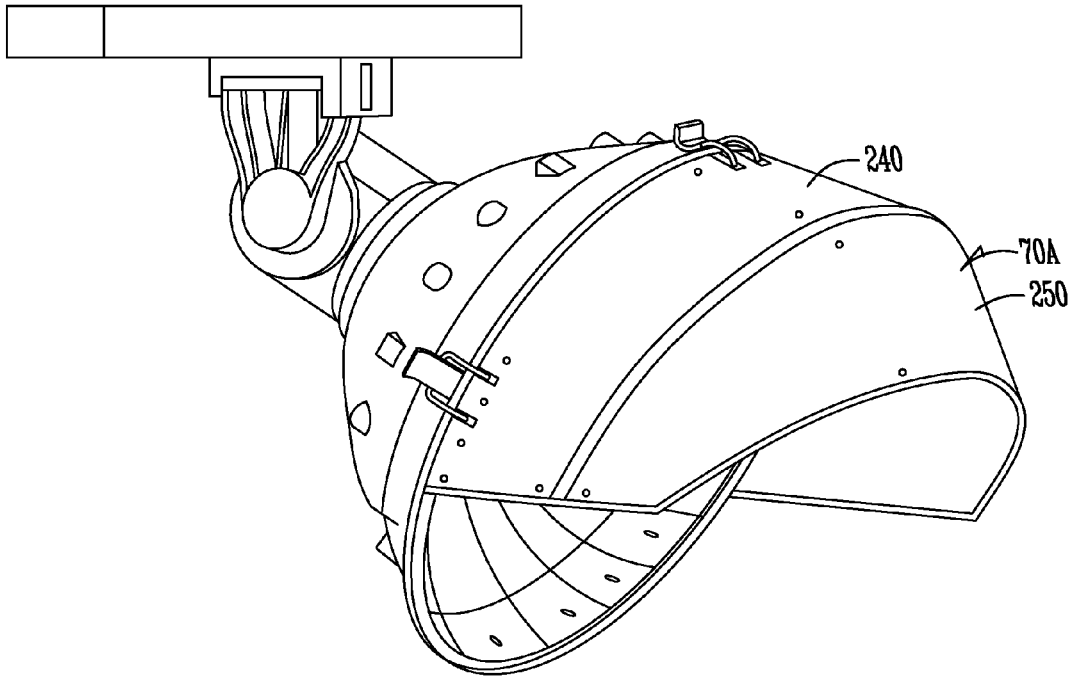
Figure 2B:
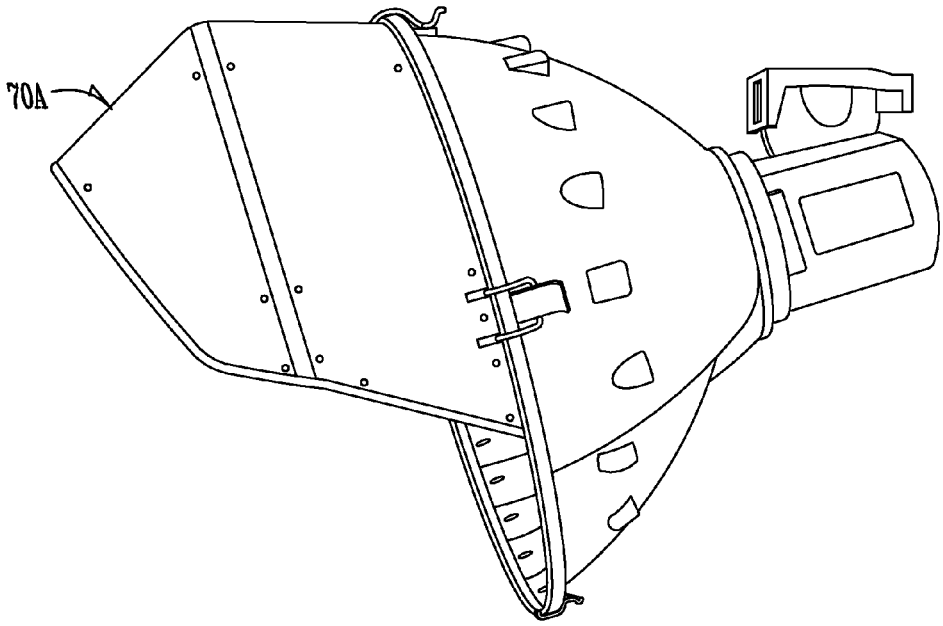

FIGS. 2A-B are various views of the fixture of FIG. 1 with a first exemplary embodiment of a visor (sometimes referred to as the short visor) according to the present invention.

Figure 3A:
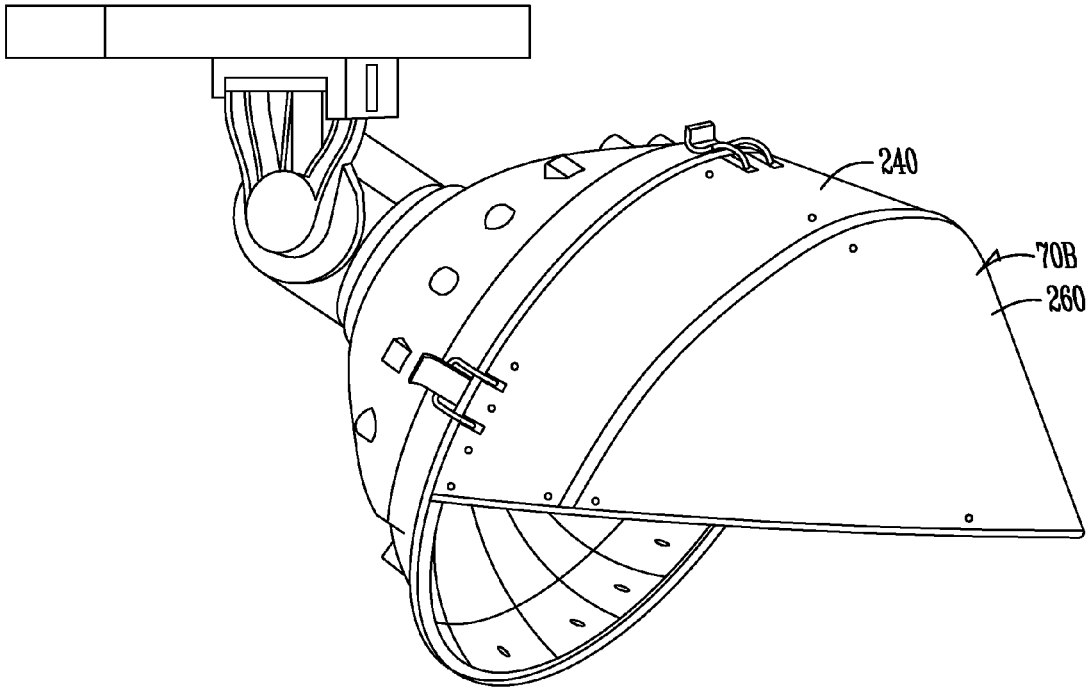
Figure 3B:
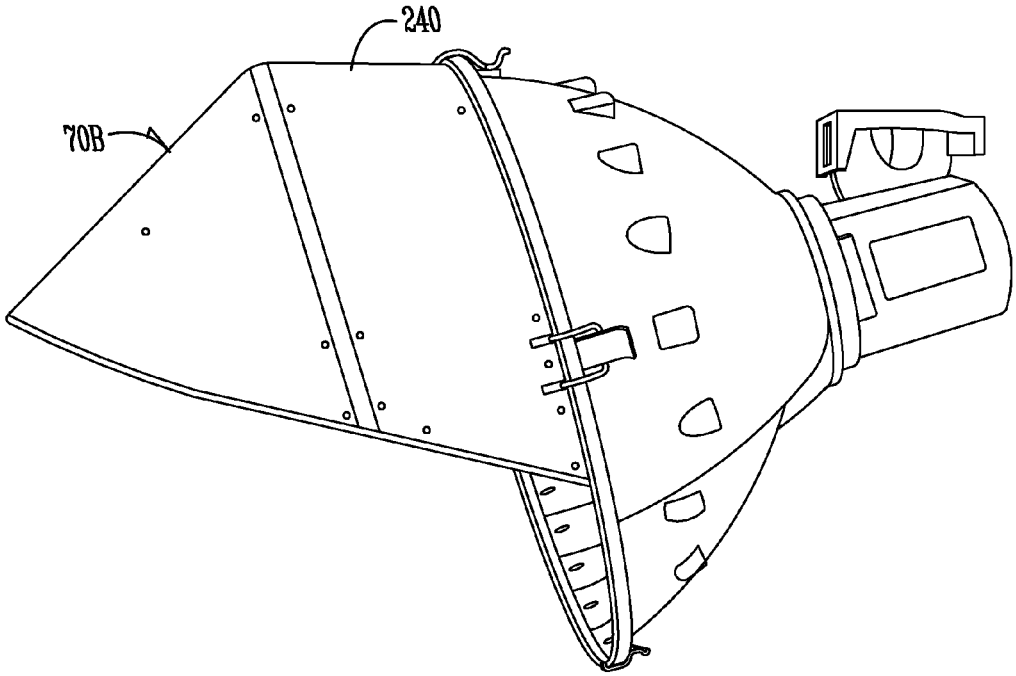

FIGS. 3A-B are similar to FIGS. 2A-B but with a second exemplary embodiment of a visor (sometimes referred to as the long visor) according to the present invention.

Figure 4B:
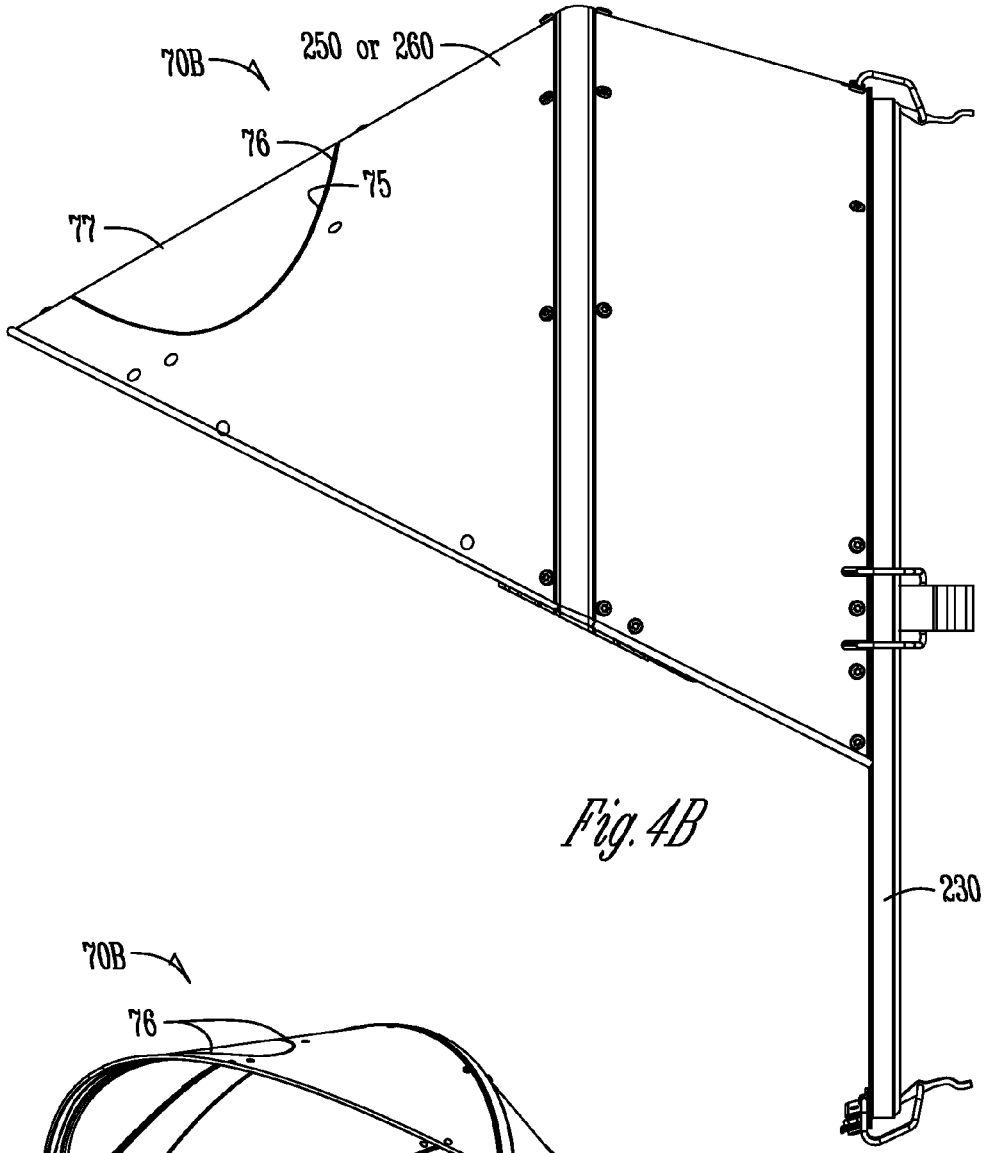
Figure 4A:
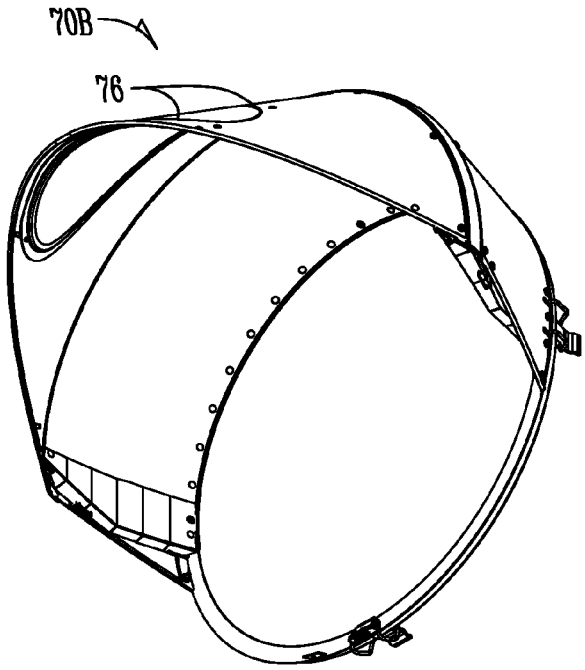
Figure 5A:
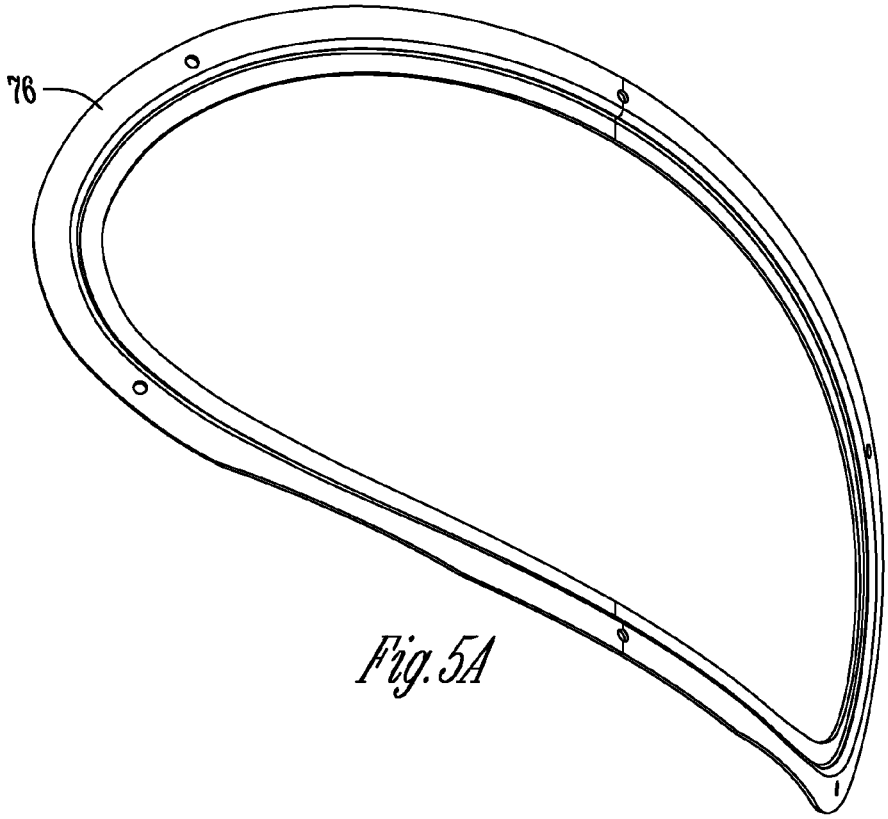
Figure 5B:
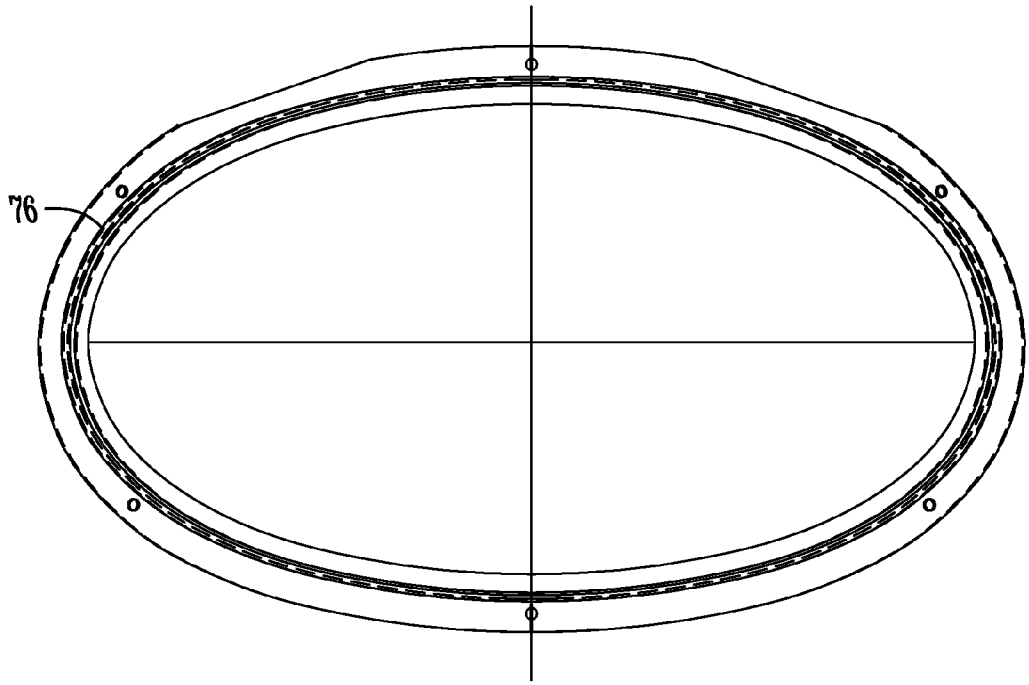
Figure 5C:
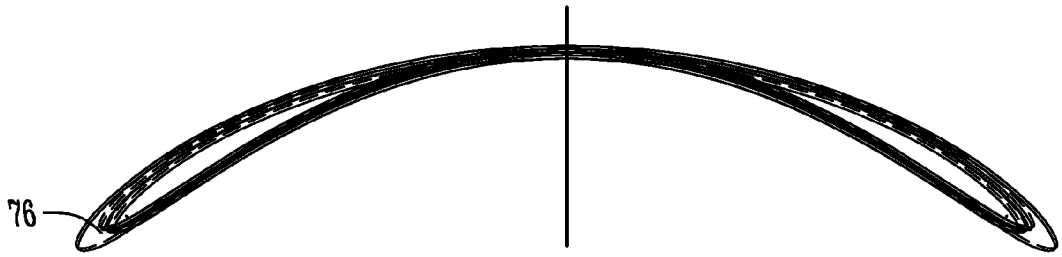
Figure 5D:
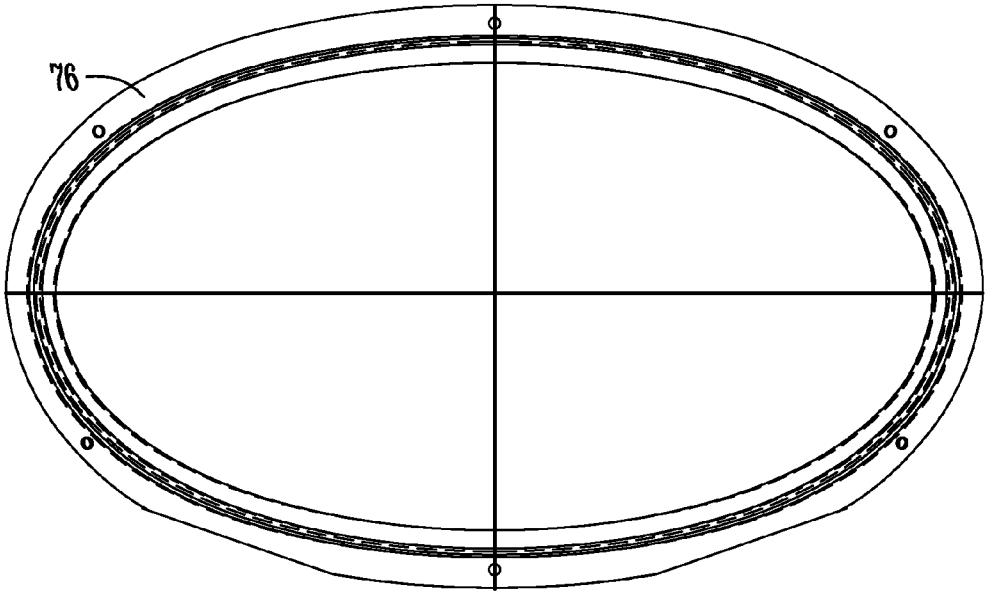
Figure 5E:
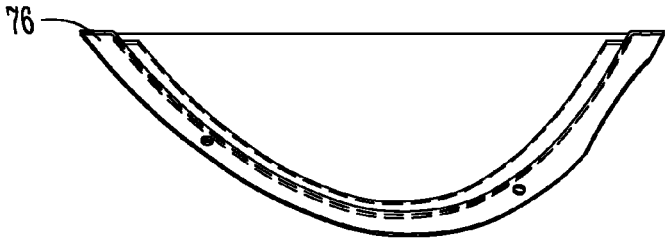
Figure 6A:
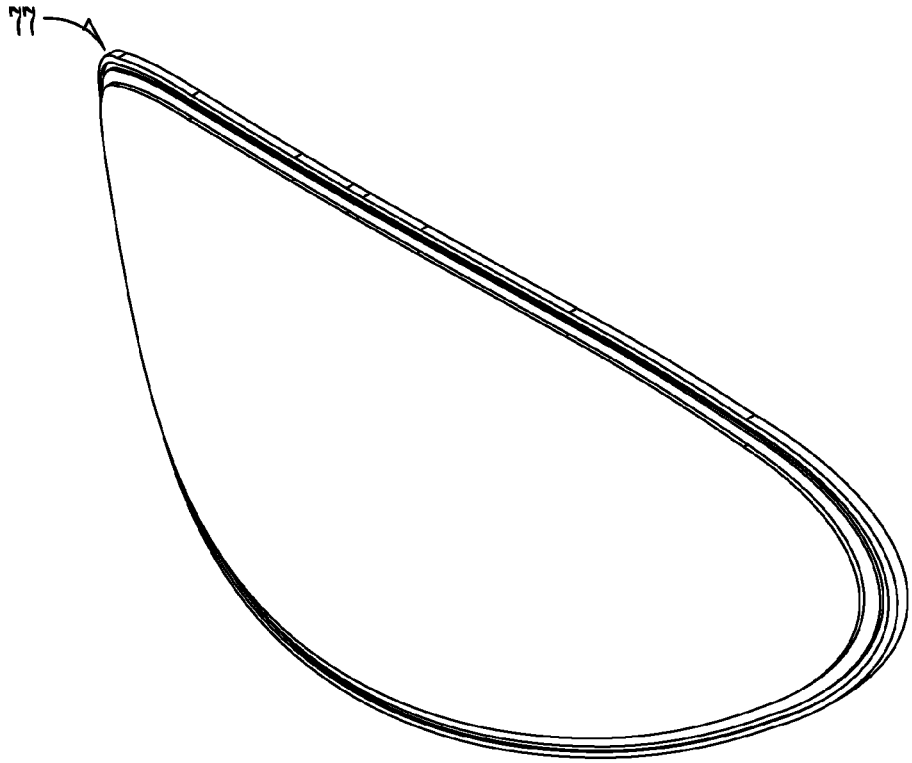
Figure 6B:
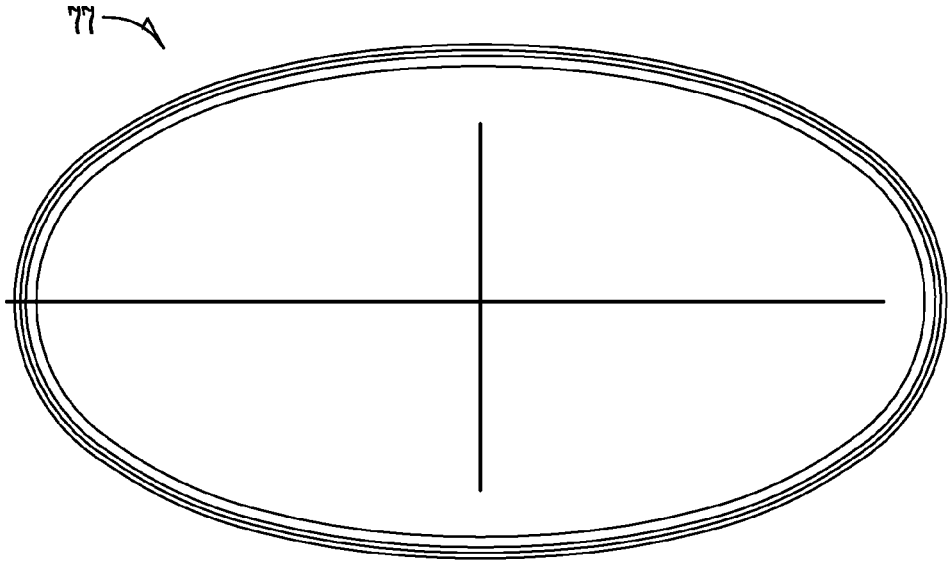
Figure 6C:
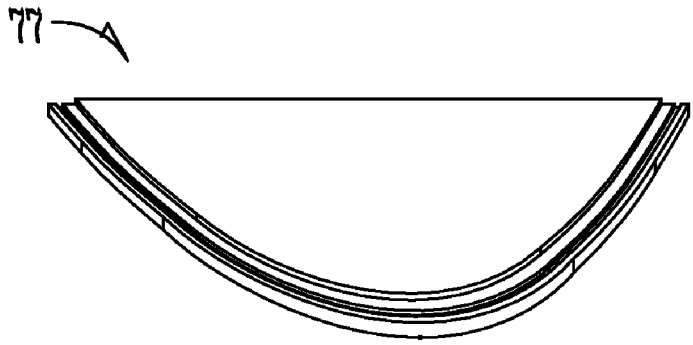
Figure 6D:
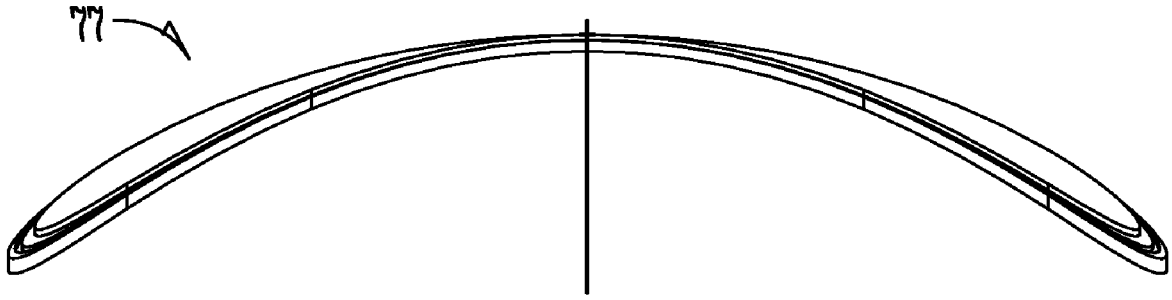

FIGS. 4A-B are various assembled views of a visor with an aperture (FIG. 4A) into which a frame (FIGS. 5A-E) can be mounted. A translucent insert (FIGS. 6A-D) is, in turn, mounted in the frame. This combination can provide "uplighting" from the fixture to provide some additional illumination above the target space (e.g. for improved playability of a sports field).

IV. DETAILED DESCRIPTION OF EXEMPLARY EMBODIMENTS

FIG. 1 shows the basic components of sports lighting fixture 10 in exploded form. FIGS. 2A and B show it in perspective form.

Reflector frame 30 (cast aluminum type 413) bolts to lamp cone 40. The frame for glass lens 3 is removably latched to the front of reflector frame 30. Visor 70 is mountable to the lens frame and extends from the upper front of reflector frame 30 when in place. It includes high reflectivity strips on its interior 72 (see U.S. Pat. No. 6,036,338).

As indicated by comparing FIGS. 2A and B with FIGS. 3A and B, visor 70 can take different shapes and forms. A first style of visor 70A (FIGS. 2A and B) is shorter and does not extend forwardly and downwardly as much as second visor style 70B (FIGS. 3A and B). Both have an identical base section 240 that extends initially at a less converging angle from reflector frame 30. A distal extension section connects to the base section and angles back inwardly toward the central axis of reflector frame 30. The shorter visor 70A uses a shorter extension section than the longer visor 70B. Visor 70B is useful, for example, when fixture 10 is aimed at angles closer to horizontal. It would block and redirect more light that would otherwise go off the target area, as compared to visor 70A.

As indicated at FIG. 1, a visor 70 is attachable to fixture 10. High total reflectivity material 72 is mounted on its inner or downward-facing side. Essentially the exterior of visor 70 is a protective cover over the high reflectivity material it supports. FIGS. 4A-4B illustrate two general forms visor 70 can take.

Either form of visor 70 actually is larger in size than many existing visors, and increases the overall size of fixture 10. However, their shape and configuration has been designed to actually decrease wind load by on the order of 40% over conventional fixtures. The length, shape, and edges of visors 70 are designed to improve the EPA of the whole fixture 10. They are cost effective with excellent reflection efficiency.

The two general forms for visor 70 are illustrated in the drawings (see, e.g., short visor 70A of FIG. 2A-B and long visor 70B of FIG. 3A-B). Both start with a base visor section 240 that is attached to lens rim 230 by rivets, bolts or other means. A second or outer visor section, either short visor section 250 or long visor section 260, is attached by rivets, bolts or otherwise to base visor 240.

Base visor section 240 is attached to the lens rim (with glass lens 3 installed). Lens rim clips can latch lens the rim to the reflector frame 30. The lens rim generally matches the perimeter opening to reflector frame 30. A base visor section 240 is welded or riveted into a slot of the lens rim and supported by an arm. The slot holds glass lens 3. Other slots allow connection to reflector frame 30. A lens gasket cushions and seals glass lens 3.

Visor 70 acts both to block and redirect light that otherwise likely would go off target. The high reflectivity material for the visor reflecting surface reduces light loss and thus provides more light to the target area, even over prior visors that have some reflectivity. It provides significant light gains compared to conventional visors that simply block or absorb most or all of the light that strike it.

The shape of visor 70 is designed to achieve several functions. First, it supports the highly reflective inserts in a manner that controls spill and glare light. Second, it supports the reflective inserts in a manner which minimizes light loss, and can increase light to the target. Third, its shape minimizes the projected area of the visor and the fixture generally to produce a low coefficient of drag. Fourth, it accomplishes these functions in a relatively low cost but efficient way. Fifth, it provides a controlled amount of uplight through a somewhat light transmissive insert in visor 70 (see FIGS. 4A-B).

Even though the overall size of fixture 10 is larger than some conventional similar fixtures, the wind drag is reduced on the order of 40% or more. Spill and glare can be controlled with a visor 70, and also with other features, if used (e.g. lower initial output intensity, side shift, reflecting surfaces that highly control direction of light). This can allow cheaper poles to be utilized, which can significantly reduce overall capital cost of a lighting system. Less wind drag means the strength of the pole that elevates the fixtures can be less.

The uplighting feature for visor 70 is shown in FIGS. 4A-B. An opening 75 (FIG. 4A) is formed in the visor extension portion 250 or 260. A frame 76 (FIGS. 5A-E) can be screwed, bolted, or otherwise attached in opening 75. A light transmissive material or insert 77 (FIGS. 6A-D) is secured in frame 76. Its shape can be basically an oblong in plan view shape to form a kind of an "eyeball" shape. Usually, insert 77 is a translucent material or has properties to diffuse the light. For example, it could be translucent to limit the amount of light (e.g. 2000 candela) that comes though it to provide some intensity, but not a lot, and diffuse the light, above the target. Alternatively, or in addition to, insert 77 can have a diffractor surface or surfaces (like with many fluorescent lights) to spread the light energy. Another alternative to translucent could be coloring (e.g. gray) or tinting (i.e. a darkening agent) the insert to control the amount of light coming through. Still further the insert surface could be sand blasted or acid etched inside and out. When lamp 20 is on, this adds some candlepower to the space above the target area. This can be helpful to allow players and spectators to better see balls or objects well above the ground (e.g. high fly baseballs). Preferably some type of insert would be used in the visor opening. It could be transparent or translucent (e.g. plastic, glass, polycarbonate, acrylic, etc.). It could have optical qualities to diffuse light. For sports lighting, it is contemplated it would be translucent to place some quantity of light above the field but not provide direct view to the light source or become a source of glare (e.g. to a viewer from the stands or outside of the target field, the opening would merely glow), or shift a significant amount of light from the light source away from the field.

Optionally a prismatic material could be used in the visor opening for different lighting effects. An angled stepped prismatic reflector inside reflector 70 could also be used. Black paint could be used on the opposite sides of the visor reflecting surface for extreme glare and spill light control.

It is to be understood that a further option for the uplight function for the visor could be customization for a particular application. For example, a team color or symbol could be imprinted on the translucent insert. Still further, the visor, or the whole reflector frame/visor combination could be painted, ornamented, or otherwise configured in the colors of a team or school. Because the reflector frame and visor exteriors are cast, and do not contain the reflecting surface, painting is a more viable option.

The uplighting from inserts 77 can provide a more pleasant environment. It can provide a "soft" light. It can reduce the perception of glare, which can reduce what is sometimes called annoying or discomfort glare.

Also, insert 77 can be used in combination with visor 70 or components added to visor 70 (e.g. louvers) to assist in glare or spill control or other lighting effects. Prismatic or other surfaces could be added to the interior of visor 70 or to any louvers or other surfaces of visor 70. There could be curved, angled, or stepped reflective strips in visor 70 for additional manipulation of light. Different such components could be available to produce different performance or playability options for each fixture 10.

It will be appreciated that the foregoing exemplary embodiment is given by way of example only and not by way of limitation. Variations obvious to those skilled in the art will be included in the invention. The scope of the invention is defined solely by the claims.

For example, variations in dimensions, materials, and combinations are contemplated by the invention. In particular, all of the features and aspects of the exemplary embodiment are not required to produce a beneficial or advantageous result.

What is claimed is:

1. A high intensity lighting fixture for providing useable light to a target area comprising:

a. a reflector assembly a mountable to mounting structure for elevation and support of the lighting fixture, the reflector assembly adapted to cooperate with a light source to capture and control light into a high intensity beam having a general aiming axis and a candlepower, the reflector assembly comprising a reflecting surface substantially surrounding the light source, an opening through which at least a substantial portion of the beam projects, and a lens covering the opening so that the light source is enclosed by the reflector assembly;

b. a visor assembly mounted to and extending outwardly from the reflector assembly the visor assembly having a shape and total area comprising a base portion at the reflector assembly and a distal portion that extends substantially away from the opening of the reflector assembly to block and redirect a substantial amount of light from the light source to reduce glare and spill light from the fixture, the visor assembly further comprising an opening, the opening comprising a substantial area relative the total area of the visor assembly adapted to retain a level of glare and spill control but simultaneously allow a controlled amount of light through the visor to provide a candlepower to the space outside the visor in directions generally away from the aiming axis of the beam effective for a level of uplight illumination of objects in the space.

2. The lighting fixture of claim 1 wherein the visor comprises an exterior which, in combination with the reflector assembly, presents a relatively improved effective projected area (EPA) and aerodynamic characteristics compared to conventional spun aluminum reflector fixtures, the exterior comprising the base extending substantially directly outwardly from the opening of the reflector assembly and the distal portion converging toward the aiming axis.

3. The lighting fixture of claim 1 further comprising a translucent material in the opening of the visor assembly.

4. The lighting fixture of claim 3 wherein the translucent material is a light attenuating material.

5. A visor for a high intensity lighting fixture comprising:

a. a visor assembly adapted to mount as an outward extension from a top perimeter of an opening of a reflector assembly from which opening a light beam emanates from the lighting fixture and having an outer side and an inner side with a reflective surface, the visor assembly having a shape and total area comprising a base portion at the reflector assembly and a distal portion that extends substantially away from the opening of the reflector assembly to block and redirect a substantial amount of light from the light source to reduce glare and spill light from the fixture;

b. an opening, the opening comprising a substantial area relative the total area of the visor assembly through the reflective surface and the visor assembly adapted to retain a level of glare and spill control but simultaneously allow a controlled amount of light through the opening of the visor assembly, the opening of the visor assembly comprising a substantial area relative the visor reflective surface and the visor assembly effective for a level of uplight illumination of objects in space outside the visor assembly.

6. The visor of claim 5 further comprising an at least partially light transmitting material in the opening of the visor assembly.

7. The apparatus of claim 5 further comprising a translucent material in the opening of the visor assembly.

8. A method of allowing a controlled amount of light above a target area for a high intensity lighting system including a plurality of enclosed lighting fixtures producing controlled, concentrated high intensity beams elevated to substantial heights relative the target area comprising:

a. placing visors on at least selected lighting fixtures illuminating the target area, the visors having a shape and total area effective to provide glare and spill light control;

b. including an opening in at least some of the visors, the opening comprising a substantial area relative the total area of the visor adapted to retain a level of glare and spill control but simultaneously to allow light upward generally above the lighting fixture to provide candlepower to the space above the target area effective for a level of uplight illumination of objects in the space above the lighting fixtures.

9. The method of claim 8 wherein the opening includes an at least partially light transmitting material.

10. The method of claim 8 wherein the opening includes a translucent material.

* * * * *

UNITED STATES PATENT AND TRADEMARK OFFICE

CERTIFICATE OF CORRECTION

PATENT NO. : 7,467,880 B2
APPLICATION NO. : 11/333995
DATED : November 23, 2008
INVENTOR(S) : Myron K. Gordin et al.

It is certified that error appears in the above-identified patent and that said Letters Patent is hereby corrected as shown below:

Claim 1, Column 5, line 26
DELETE:
After assembly "a"
ADD:
Before mounting --a--

Claim 1, Column 5, line 37
ADD:
After assembly --,--

Signed and Sealed this

Tenth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,467,880 B2
APPLICATION NO. : 11/333995
DATED : December 23, 2008
INVENTOR(S) : Myron K. Gordin et al.

It is certified that error appears in the above-identified patent and that said Letters Patent is hereby corrected as shown below:

Claim 1, Column 5, line 26
DELETE:
After assembly "a"
ADD:
Before mounting --a--

Claim 1, Column 5, line 37
ADD:
After assembly --,--

This certificate supersedes the Certificate of Correction issued February 10, 2009.

Signed and Sealed this

Tenth Day of March, 2009

JOHN DOLL
*Acting Director of the United States Patent and Trademark Office*